US006213670B1

(12) United States Patent
Wien

(10) Patent No.: US 6,213,670 B1
(45) Date of Patent: Apr. 10, 2001

(54) BINDERS WITH A FOLDABLE POCKET ASSEMBLY

(75) Inventor: Thomas Wien, Newport Beach, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/360,664

(22) Filed: Jul. 26, 1999

(51) Int. Cl.[7] ..... B42F 13/00; B42F 3/00

(52) U.S. Cl. ..... 402/73; 402/74; 402/75; 281/29; 190/109; 190/111; 190/900; 190/901; 190/903

(58) Field of Search ..... 402/73, 74, 75; 281/29; 190/109, 111, 900, 901, 903

(56) References Cited

U.S. PATENT DOCUMENTS

| | | | | |
|---|---|---|---|---|
| D. 352,604 | * | 11/1994 | Johnson | 190/903 |
| D. 354,983 | | 1/1995 | Tumulty . | |
| D. 382,900 | | 8/1997 | Wyant . | |
| 1,841,741 | | 1/1932 | Labadie . | |
| 2,113,099 | | 4/1938 | Sloan . | |
| 2,244,091 | | 6/1941 | Wein . | |
| 2,677,376 | | 5/1954 | Brunner . | |
| 3,221,751 | | 12/1965 | Brandon . | |
| 3,351,064 | | 11/1967 | Cohn . | |
| 4,318,471 | | 3/1982 | Hutton . | |
| 4,588,321 | | 5/1986 | Egly . | |
| 4,629,349 | | 12/1986 | Pitts . | |
| 4,639,157 | | 1/1987 | Herzfeld . | |
| 4,838,724 | * | 6/1989 | Spence, Jr. | 402/79 |
| 4,848,798 | | 7/1989 | Moor . | |
| 4,964,508 | | 10/1990 | Balsley . | |
| 5,002,401 | | 3/1991 | Blackman . | |
| 5,294,208 | | 3/1994 | Tremmel et al. . | |
| 5,350,249 | | 9/1994 | Peters . | |
| 5,366,248 | | 11/1994 | Donvan et al. . | |
| 5,394,964 | | 3/1995 | White . | |
| 5,494,366 | * | 2/1996 | Pell et al. | 402/73 |
| 5,738,460 | | 4/1998 | Flynn . | |

* cited by examiner

*Primary Examiner*—A. L. Wellington
*Assistant Examiner*—Mark T. Henderson
(74) *Attorney, Agent, or Firm*—Oppenheimer Wolff & Donnelly LLP

(57) ABSTRACT

The present invention is generally directed to a foldable pocket assembly that is coupled to a cover of a binder along one of the edges of the pocket assembly. The pocket assembly has a first portion and a second portion divided by a fold line. The second portion is foldable along the fold line and adapted to releasably hold in the folded position adjacent to the first portion. Each portions may have a pocket or adapted to hold pencils and pens. As such, the present invention makes more efficient use of the space left between the cover and the papers held in the three ring binder to increase the carrying capacity of the binder. Furthermore, some pockets are not visible so that sensitive items may be more securely held in the hidden pockets.

27 Claims, 2 Drawing Sheets

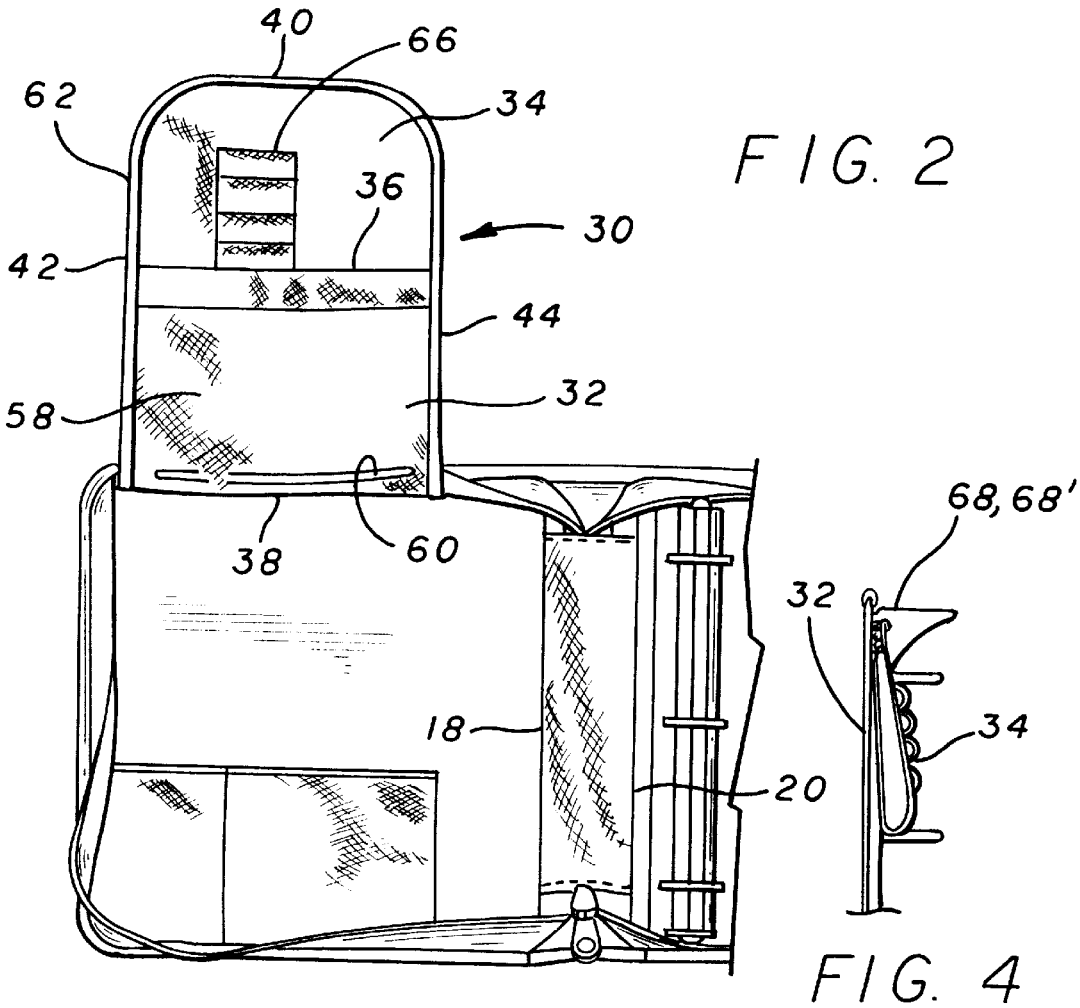
FIG. 2
FIG. 4
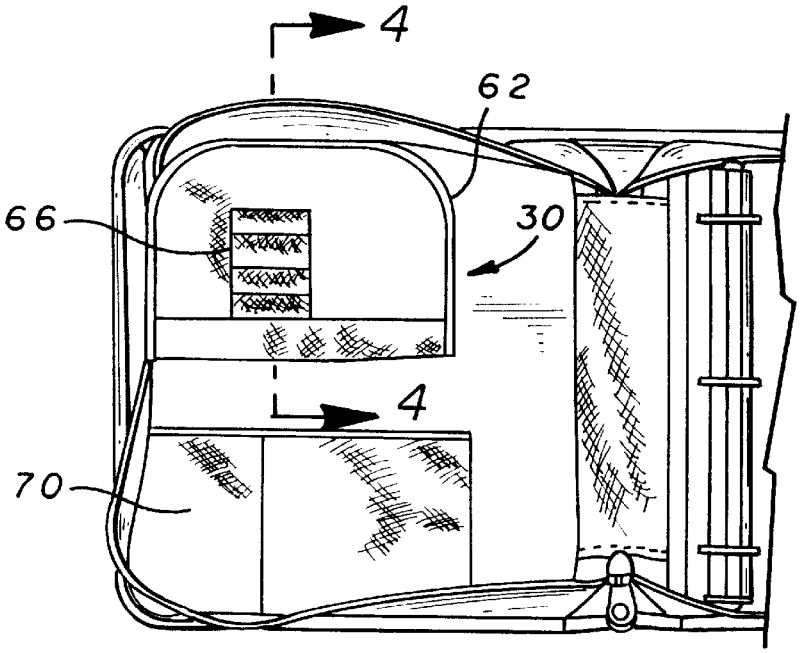
FIG. 3

BINDERS WITH A FOLDABLE POCKET ASSEMBLY

BACKGROUND OF THE INVENTION

1. Field of Invention

This invention relates generally to a binder with a foldable pocket assembly.

2. Description of the Related Art

The carrying capacity of binders is generally limited to the space between its front and back covers. To increase the carrying capacity of binders, the binders are simply made bigger. That is, the size of the covers are either made bigger or the spine between the covers is made wider. Simply making bigger binders however has number of shortcomings. For example, bigger binders would weigh and cost more, and make it more cumbersome to carry around and store.

To better utilize the space between the covers, some binders have pockets inside the covers. However, these interior pockets are not economically utilized. That is, once the covers of the binder are closed there is a void or space between the front cover and the papers being held by the three ring holder mechanism. The void exists because the three ring holder mechanism generally protrudes out from the spine or the back cover so that the papers slope down against the back cover, and the negative slope of the papers forms a void or space between the paper and the front cover. Some binders do have interior pockets on the inside of the covers, but these pockets do not take full advantage of the void, because the interior pockets do not bulge or expand to take advantage of the void. In other words, the pockets are attached to the cover around at least three of the edges of the pockets so that the pockets are held close to the cover and cannot bulge or expand into the void.

Furthermore, because at least three edges of the pockets are attached to the cover, flexibility, expandability and security are not fully available. Accordingly, there are no secret pockets to hide sensitive items so that they are securely held in a confidential location.

Accordingly, there still is a need for a binder that makes more efficient use of the space between the covers to carry more items by taking advantage of the void left between the cover and the papers held in the three ring binder mechanism, and to have some secure secret pockets to hide sensitive items.

OBJECT AND SUMMARY OF THE INVENTION

A general object of the present invention is to make more efficient use of the void left between the cover and the papers held in the three ring binder to increase the carrying capacity of the binder. Yet another objective is to provide some pockets that are hidden so that sensitive items may be more securely held in the hidden pockets. These and other objectives are accomplished by providing a binder with a front and back covers, and a spine coupling the front and back covers along a front fold line and a back fold line, respectively; and a pocket assembly having a top edge, a bottom edge, a left edge, and a right edge defining outer edges of the pocket assembly, wherein the top edge of the pocket assembly is coupled to the front cover of the binder, wherein the pocket assembly has a top portion and a bottom portion defined by a fold line, wherein the bottom portion of the pocket assembly is foldable along the fold line and adapted to hold the bottom portion adjacent to the top portion of the pocket assembly.

In accordance with a broad aspect of the invention, the objectives may be accomplished by providing a binder with a front and back covers; and a pocket having outer edges defining the pocket, wherein the pocket is coupled to the front cover of the binder along not more than two of the outer edges of the pocket, and wherein the pocket is foldable and is adapted to be releasably held in a folded position.

The above described features of the present invention and many other of its attendant advantages will become apparent from a consideration of the following detailed description when considered in conjunction with the accompanying drawings.

BRIEF DESCRIPTION OF THE DRAWINGS

Detailed description of the preferred embodiment of the invention will be made with reference to the accompanying drawings.

FIG. 2 is an interior view of the front cover of a binder with an exemplary foldable pocket assembly raised over the front cover showing the back side of the foldable pocket assembly;

FIG. 3 is an interior view of the front cover of a binder with an exemplary foldable pocket assembly in a folded position; and FIG. 4 is a cross-sectional view of an exemplary foldable pocket assembly along cross-section 4—4 of FIG. 3.

DETAILED DESCRIPTION OF THE PREFERRED EMBODIMENTS

Figure 1:
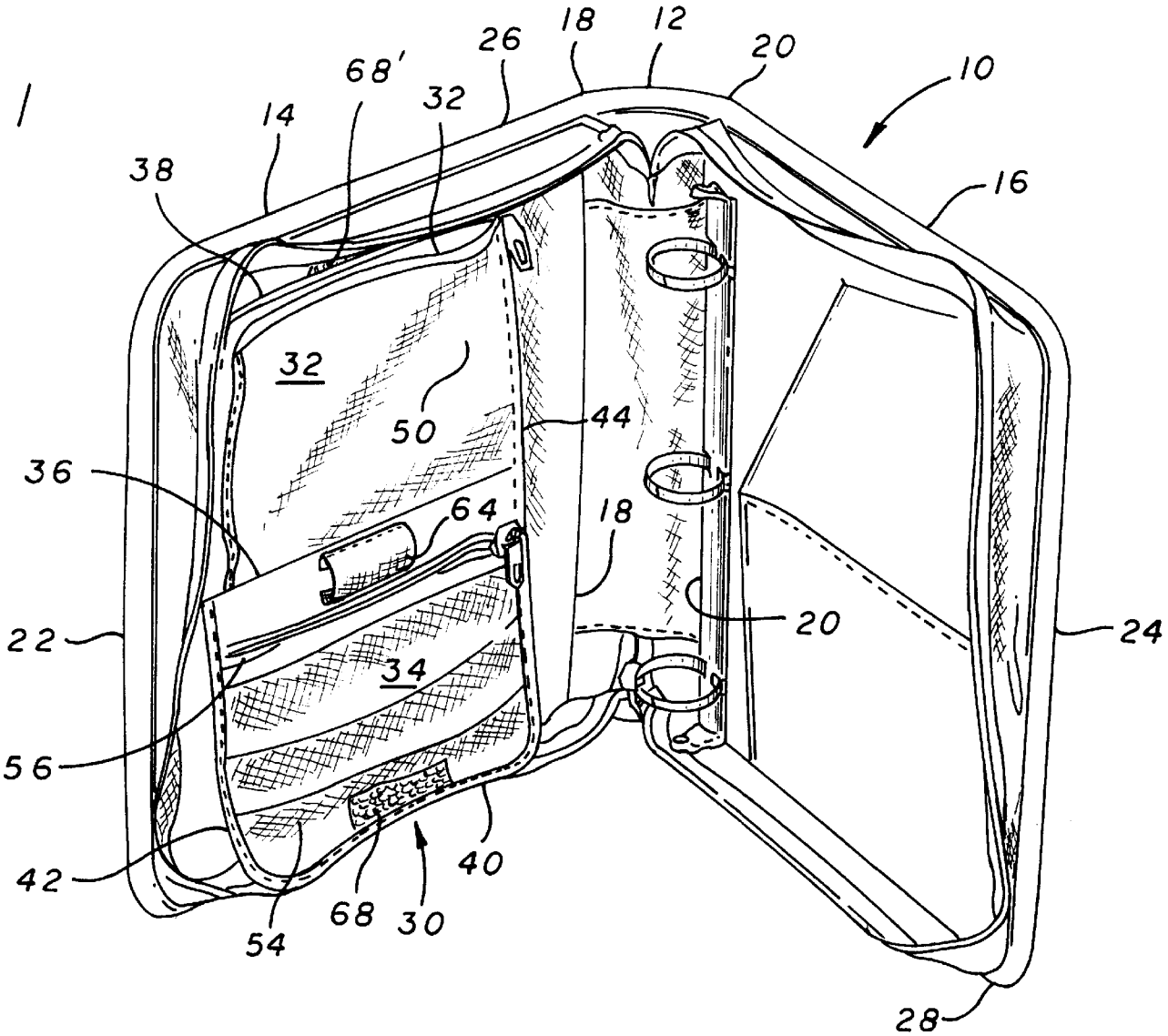
FIG. 1 is a perspective view of the interior of a binder in an open position with an exemplary foldable pocket assembly within the binder.

Disclosed herein is a detailed description of a best presently known modes of carrying out the invention. This description is not to be taken in a limiting sense, but is made merely for the purpose of illustrating the general principles of the invention. The section titles and overall organization of the present detailed description are for the purpose of convenience only and are not intended to limit the present invention.

As illustrated for example in FIG. 1, a binder 10 is shown, which is constructed to hold standard size sheets of 8½ by 11 inches, or A-4 size paper. The binder 10 includes a spine 12, a front cover 14, and a back cover 16 connected to the opposite edges of the spine 12, along fold lines 18 and 20, respectively. The front and back covers and the spine define the outer edges of the binder 10, i.e., a front edge 22, back edge 24, top edge 26, and bottom edge 28. The front and back covers 14,16 have a preferred width of about eleven inches and height of about thirteen inches. The binder 10 may also be sized to accommodate paper sheets larger or smaller than 8½ by 11 inches. For example, typical carry-type organizers and calendars are usually about 5 inches by 7 inches, while binders for photo albums can be about 12 inches by 15 inches.

The front and back covers and the spine each has an inner base (not shown) to give the respective covers and the spine a body with the dimensions as discussed above. The respective inner bases provide structural support, yet they are somewhat flexible so that the covers are able to contour around the items being held with some resistance. The inner base is preferably made of suitable paper board or other suitable material. The respective inner bases are also enclosed by a suitable material that is known to one who is ordinarily skilled in the art to form an outer covering; preferably a fabric, nylon or plastic sheet material is used to enclosed the inner bases. Still further, a thin foam layer (not shown) may be provided between the inner base and the enclosed fabric to give the binder a softer feel.

As illustrated by way of example in FIGS. 1 through 4, the binder 10 has an exemplary foldable pocket assembly 30

(hereinafter assembly 30) on the interior side of the binder, which may be over stuffed to efficiently utilize the space between the front cover and the papers on the three ring holder mechanism. The assembly 30 includes a first portion 32 and a second portion 34 divided by a fold line 36. The combination of the first and second portions 32, 34 define the assembly 30 with a top edge 38, bottom edge 40, left edge 42 and right edge 44. Preferably, the assembly as defined by the edges substantially extends along the height of the front cover to maximize the carrying capacity of the pockets. The assembly as illustrated in FIG. 1, in the unfolded position shows the front side of the assembly 30. In FIG. 2, the assembly 30 is raised over the binder to illustrate the backs side of the assembly. Preferably, the assembly is coupled to the front cover of the binder along the top edge 38, with other three edges 40, 42, and 44 unattached to the front cover. However, it is within the scope of the present invention to couple the assembly to the binder along any one of the edges, i.e. 40, 42, or 44. Alternatively, the assembly may be coupled to the binder along any of the two adjacent edges, so that when the assembly is folded, it forms a triangular-shaped folded pocket assembly.

Preferably, the assembly has a plurality of pockets, each serving different functions. For example, the first portion 32 on the front side may include a first pocket 50 substantially encompassing the first portion. The outer edges of the first pocket may be sealed, except in one edge to leave an opening 52 to allow a user to insert and take out a particular item from the first pocket 50. In this embodiment, the first pocket has the opening along the top edge 38 of the assembly. Alternatively, the opening 52 may be adjacent to any of the other edges 42, 44, or even the fold line 36. Likewise, the second portion 34 may have a second pocket 54 with an opening 56 adjacent to the fold line 36 or adjacent to any other edges 40, 42, and 44.

One of the advantage with above construction is that the pockets 50, 54 may be hidden from non-users to secretly store items which may be sensitive if found. As best illustrated in FIG. 4, once the first and second pockets are filled, the second portion may be folded along the fold line and held adjacent to the first portion, thereby concealing the first and second pockets from others. The second portion 34 is preferably held adjacent to the first portion 32 by a VELCRO hook and loop system 68 and 68', as best shown in FIG. 4. Furthermore, another secret pocket, a third pocket 58, may be formed on the back side of the first portion of the assembly 30, as illustrated by way of example in FIG. 2. Like other pockets, an opening 60 may be formed along any of the edges, 38, 42, 44, or along the fold line 36. Preferably, the opening 52 is formed adjacent the top edge 38. In particular, even when the assembly 30 is in the unfolded position, the third pocket is not exposed to non-users, so that a user may secretly hold sensitive items in the third pocket.

Another advantages with coupling the assembly 30 to the front cover along one of the edges is that the pockets in the assembly 30 may be overstuffed to take full advantage of the void or space between the front cover and the papers in the three ring holder mechanism. The pockets in the assembly 30 may be over stuffed and bulge out because only the top edge 38 is coupled to the front cover with other three edges free to expand outwardly. To properly align the assembly, the right edge 44 is preferably coupled to the inside of the front cover approximately 1 to 4 inches left from the fold line 18 so that as the front cover is closed the assembly 30 is juxtaposed to the papers held by the three ring mechanism and not over the three ring mechanism. Accordingly, the overstuffed pockets in the assembly are alinged to fill the void left between the front cover and the papers in the three ring mechanism. Once the pockets are filled the second portion of the assembly may be either left unfolded or folded up, as shown in FIGS. 1 and 3, respectively, before closing the binder. Alternatively, the assembly 30 may be also coupled to the back cover.

As illustrated in FIGS. 1 and 2, along with the pockets, a pen holder 64 may be formed on the front of the assembly 30 to hold pens and pencils, for example. Alternatively, a plurality of pen holders 66 may be formed in the back side of the second portion of the assembly, as illustrated in FIG. 3.

The openings 52, 56 are preferably adapted with a closure mechanism, such as a zipper or VELCRO hook and loop system to open and close the openings to securely hold the items in the pockets. To easily verify the items being held in the pockets, some pockets may be made of transparent material or meshed fabric; while other pockets with more sensitive items may be made of non-transparent materials.

With regard to material, the pockets should be flexible and may be of resilient or expandable material to contour around the shapes of the items being held, yet the material should be elastic enough to return to its original shape once the items are removed. Furthermore, the material may be transparent or opaque or of mesh material, so that a user can see whether a particular item is within the pocket. Further, the pockets are preferably treated with UV coating to protect against harmful effects of the ultra violet rays from the sun. In this regard, the pockets may be made of fabric, polyester, polyvinyl chloride, and Nylon, for example, or they may be made from other materials exhibiting the qualities discussed above that are known to one ordinarily skilled in the art.

To have an aesthetically pleasing appearance, for example, the pockets may be provided with a liner (thin strip) 62 to contour around the assembly to provide a smooth high quality finish around the edges of the pockets.

As noted in FIG. 3, for example, a lower conventional pocket 70 may be provided. Instead of the pocket 70, an additional foldable pocket may be provided, substantially identical to the pocket assembly 30, to take better advantage of the available space. This additional pocket may be secured along any one of its four sides, but would preferably be oriented in the same direction as pocket assembly 30.

As another alternative (not shown), the foldable pocket may be substantially twice the size of the foldable pocket assembly 30, and may be secured along the left edge of the front cover with the notebook oriented as shown in FIGS. 1, 2 and 3. This alternative would have the pocket assembly when folded, occupy most of the space between the paper and the front cover of the binder.

Still another alternative embodiment is to have a large single pocket that may be foldable along the center line, and adapted to be releasably held in the folded position. In this embodiment, the large single pocket may be coupled to the front cover along any one of its edges. When unfolded, such a large pocket may have an extent substantially equal to the front cover of the binder.

Although the present invention has been described in terms of the preferred embodiments above, numerous modifications or additions to the above-described preferred embodiments would be readily apparent to one skilled in the art. Thus, by way of example and not of limitation, the pockets may be formed inside of a variety of binders such as a typical carry-type organizers which are usually about five inches by seven inches, while binders for photo albums can be about twelve inches by fifteen inches. Accordingly, the present invention is not limited to the specific embodiments illustrated and described hereinabove. With respect to the claims, it is applicant's intention that the claims not be interpreted in accordance with the sixth paragraph of 35 U.S.C. § 112 unless the term "means" is used followed by a functional statement.

What is claimed is:

1. A binder with a foldable pocket assembly, comprising:

a binder with a front and back covers, and a spine coupling the front and back covers along a front fold line and a back fold line, respectively; and a pocket assembly having a top edge, a bottom edge, a left edge, and a right edge defining outer edges of the pocket assembly, wherein the top edge of the pocket assembly is coupled to the front cover of the binder, wherein the pocket assembly has a top portion and a bottom portion defined by a fold line, wherein the bottom portion of the pocket assembly is foldable along the fold line and adapted to hold the bottom portion adjacent to the top portion of the pocket assembly;

wherein the pocket assembly includes an upper pocket on the top portion of the pocket assembly, and a lower pocket on the bottom portion of the pocket assembly.

2. A binder according to claim 1, wherein the front cover of the binder has an interior side, wherein the pocket assembly is coupled to the interior side of the front cover.

3. A binder according to claim 1, wherein the pocket assembly includes an upper pocket on the top portion of the pocket assembly.

4. A binder according to claim 1, wherein the pocket assembly includes a lower pocket on the bottom portion of the pocket assembly.

5. A binder according to claim 1, wherein the pocket assembly includes an upper pocket on the top portion of the pocket assembly, and a lower pocket on the bottom portion of the pocket assembly.

6. A binder as defined in claim 1, wherein said binder has two pockets on one side of said pocket assembly, and at least one pocket on the other side thereof.

7. A binder according to claim 1, wherein the pocket assembly has a front side and a back side, wherein the pocket assembly includes a pocket on the top portion of the back side of the pocket assembly, whereby sensitive items may be secretly held in the pocket.

8. A binder with a foldable pocket assembly, comprising:

a binder with a front and back covers; and a pocket assembly having first and second portions defined by a fold line, wherein the first portion has a coupling edge, the coupling edge of the first portion of the pocket assembly coupled to the front cover or the back cover of the binder, wherein the second portion of the pocket assembly is foldable along the fold line and is adapted to hold the second portion juxtaposed to the first portion of the pocket assembly;

the first portion of the pocket assembly having a separate pocket.

9. A binder according to claim 8, wherein the pocket assembly has top, bottom, left, and right edges defining the pocket assembly, wherein the pocket assembly is coupled to the front cover of the binder along the top edge of the pocket assembly.

10. A binder according to claim 9, including a three ring mechanism coupled to the binder, wherein the right edge of the pocket assembly is predetermined distance away from the three ring mechanism, so that when the binder is in a closed position the pocket assembly inside the binder is juxtaposed to the three ring mechanism.

11. A binder according to claim 8, wherein the pocket assembly includes a pocket on the first portion of the pocket assembly.

12. A binder according to claim 8, wherein the pocket assembly includes a pocket on the second portion of the pocket assembly.

13. A binder according to claim 8, wherein the pocket assembly includes a first pocket on the first portion of the pocket assembly, and a second pocket on the second portion of the pocket assembly.

14. A binder according to claim 8, wherein the pocket assembly has a front side and a back side, wherein the pocket assembly includes a pocket on the first portion and on the back side of the pocket assembly, whereby sensitive items may be secretly held in the pocket.

15. A binder according to claim 8, wherein the pocket assembly is adapted with a VELCRO hook and loop system to hold the second portion juxtaposed to the first portion of the pocket assembly.

16. A binder according to claim 8, wherein the pocket assembly includes a at least one writing instrument holder coupled to the pocket assembly for holding a writing instrument.

17. A binder according to claim 10, wherein the right edge of the pocket assembly is approximately at least one inch away from the three ring mechanism.

18. A binder according to claim 11, wherein the pocket is made of opaque material.

19. A binder according to claim 11, wherein the pocket is made of transparent material.

20. A binder according to claim 11, wherein the pocket is made of mesh material.

21. A binder with a foldable pocket assembly, comprising:

a binder having a front and back covers; and a pocket assembly having first and second portions defined by a fold line, the first portion of the pocket assembly having a coupling edge, wherein the coupling edge is coupled to the front cover or the back cover of the binder, the second portion of the pocket assembly foldable along the fold line and adapted to hold the second portion juxtaposed to the first portion of the pocket assembly;

the pocket assembly having a front side and a back side, wherein the pocket assembly includes a first pocket on the back side of the first portion of the pocket assembly, whereby sensitive items may be secretly held in the first pocket.

22. A binder according to claim 21, wherein the pocket is made of opaque material.

23. A binder according to claim 21, wherein the pocket is made of transparent material.

24. A binder according to claim 21, wherein the pocket is made of mesh material.

25. A binder according to claim 21, wherein the coupling edge of the first portion of the pocket assembly is coupled to the front cover of the binder.

26. A binder according to claim 21, wherein the front cover has a top edge, wherein the coupling edge of the first portion of the pocket assembly is coupled to the top edge of the front cover.

27. A binder according to claim 21, wherein the pocket assembly includes an upper pocket on the first portion of the pocket assembly, and a lower pocket on the second portion of the pocket assembly.

* * * * *